US005607823A

United States Patent [19]

Nishizawa

[11] Patent Number: 5,607,823

[45] Date of Patent: Mar. 4, 1997

[54] PHOTOGRAPHIC FILM

[75] Inventor: Shinzi Nishizawa, Kanagawa, Japan

[73] Assignee: Fuji Photo Film Co., Ltd., Kanagawa, Japan

[21] Appl. No.: 542,952

[22] Filed: Oct. 13, 1995

[30] Foreign Application Priority Data

Oct. 17, 1994 [JP] Japan ..... 6-250984

[51] Int. Cl.[6] ..... G03C 1/765

[52] U.S. Cl. ..... 430/496; 430/501; 352/241

[58] Field of Search ..... 430/501, 496; 352/241

[56] References Cited

U.S. PATENT DOCUMENTS 4,340,663 7/1982 Mikawa et al. ..... 430/496

5,338,650 8/1994 Iwagaki ..... 430/501

FOREIGN PATENT DOCUMENTS 6-11794 1/1994 Japan .

*Primary Examiner*—Mark F. Huff

*Attorney, Agent, or Firm*—Sughrue, Mion, Zinn, Macpeak & Seas

[57] ABSTRACT

A photo film includes first and second edges (2*a*) extended in a length direction (X), and perforations (3) formed between at least the first edge and an effective frame region (2*b*) and arranged in the length direction at a regular pitch. The perforations (3) respectively include first to fourth corners (3*a*, 3*b*). The first and second corners (3*b*) are located close to the effective frame region (2*b*). The third and fourth corners (3*a*) are located close to the first edge (2*a*). At least the first corner (3*b*) of the perforations is curved at a radius (Ri) of curvature of 0.03 mm or less. The first corner is torn when tensile force applied to the perforations comes up to a critical value, and induces cutting of the effective frame region crosswise to the length direction.

9 Claims, 4 Drawing Sheets

PHOTOGRAPHIC FILM

BACKGROUND OF THE INVENTION

1. Field of the Invention

The present invention relates to a photographic film. More particularly, the present invention relates to a photographic film, which can be easily broken to avoid excessive force on the film and film transport devices.

2. Description of the Related Art

It has been general that photographic film in roll form, for example motion picture film, includes a base material formed from modified cellulose, an example of which is cellulose triacetate (TAC) having a high transparency. The base material requires sufficient tensile strength to avoid breakage in the course of photography, development and projection. In the photo film with the TAC base material, the base material must have a thickness of 150 μm or more to have sufficient tensile strength. This required thickness is in turn a drawback of the photo film because it is inevitable that the roll into which the thick photo film is wound has a great diameter, and is highly voluminous when the photo film is of a considerable length.

In view of this drawback, base material for film has been constructed of high tensile polyester, such as polyethylene terephthalate (PET), having sufficient tensile strength even at a thickness of 100 μm. The great tensile strength however makes it difficult to cut the film. If an accident occurs in a transport mechanism of a photo film processor, a motion picture projector, or another optical instrument where the photo film is transported. It is likely that excessive tensile force is applied to the photo film, and transmitted to the transport mechanism, of which roller shafts are deformed and damaged. The photo film is also likely to be deformed by the excessive tensile force. If a long portion of the photo film is damaged. The image and sound on this portion are last.

To overcome the shortcomings of such high tensile photo film, JP-A 6-11794 discloses an improvement in film. In this film, an auxiliary hole is formed between adjacent perforations in a rectangular or triangular shape. The auxiliary hole has a sharp corner, which, upon application of an excessive force, starts being torn, to induce breakage of the photo film in its width direction. This protects the roller shafts of handling device from deformation, and protects the photo film from stretching.

It is general for the motion picture photo film to have a sound track and/or a recording area of sound data; the sound track disposed beside the train of perforations and extended in the length direction of the photo film and the sound data recording area disposed between adjacent perforations. In the high tensile photo film, the auxiliary hole of JP-A 6-11794 is inevitably located in the sound track and/or the sound data recording area, to cut off part of the sound information. It is not practical to change the position of the sound track, because a motion picture projector would have to be redesigned for the changed position of the sound track. Also, forming the auxiliary hole in addition to the perforations raises the manufacturing cost of the photo film.

SUMMARY OF THE INVENTION

In view of the foregoing problems, an object of the present invention is to provide a photo film, which can be easily broken should excessive tensile force be accidentally applied to it, without cutting off any part of a sound information recording area.

In order to achieve the above and other objects and advantages of this invention, a photo film includes first and second edges extended in a length direction, and perforations formed between at least the first edge and an effective frame region and arranged in the length direction at a regular pitch. The perforations respectively include first to fourth corners. The first and second corners are located close to the effective frame region. The third and fourth corners are located close to the first edge. At least the first corner of the perforations is curved at a radius of curvature of 0.03 mm or less. The first corner is torn when tensile force applied to the perforations comes up to a critical value, and induces breakage of the effective frame region in a direction that is transverse to the length direction.

In the present invention, no portion of a sound information recording area is cut off, but the photo film can be easily broken, should excessive tensile force be accidentally applied to it.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
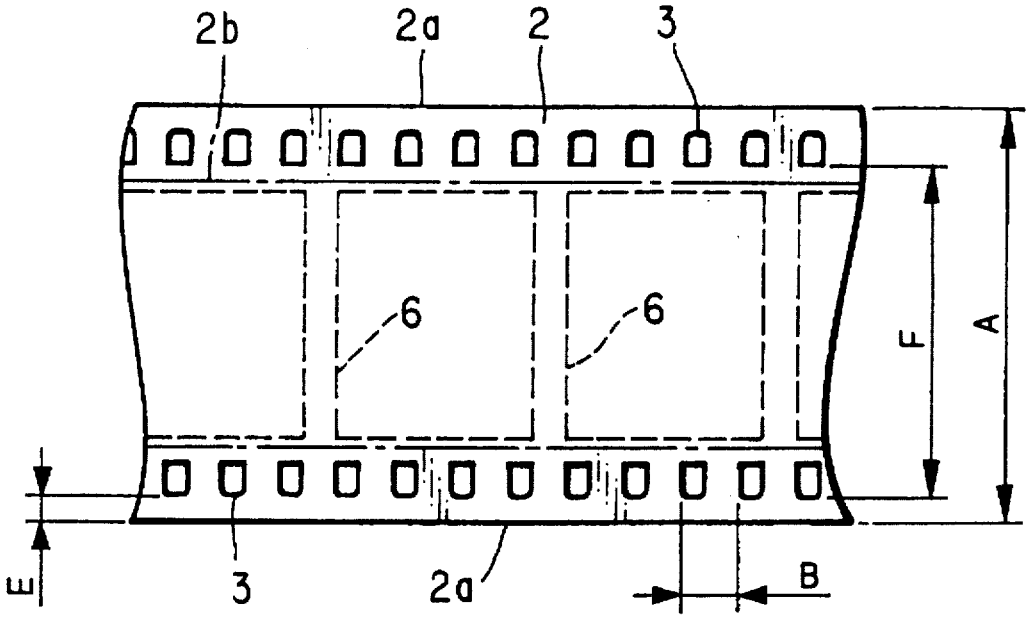
FIG. 1 is a plan view illustrating photo film of a preferred embodiment of the present invention.

FIG. 1 illustrates high tensile photo film 2 for motion pictures in accordance with a preferred embodiment of the present invention. There are trains of perforations 3 formed in the photo film 2 and arranged in the length direction X of the photo film 2. Let A be a width of the photo film 2. Let B be a pitch of the perforations 3. Let F be an interval between the perforations 3 in the width direction Y of the photo film 2. Let E be an interval between an edge **2*a* and the perforations 3**. The sizes A, B, F and E are determined in accordance with JIS-K-7552, 1981, a standard for 35 mm photo film for motion pictures.

In photography, development, and projection of the photo film 2, a sprocket wheel is engaged with the perforations 3, and rotates to feed the photo film 2 in the length direction X.

Figure 2:
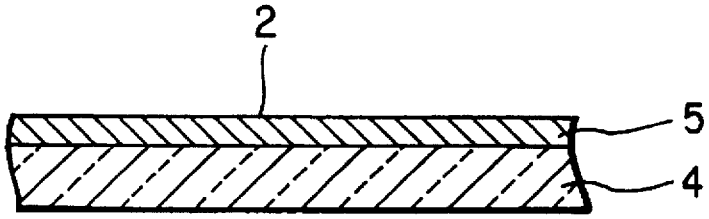
FIG. 2 is an explanatory view in section, illustrating a layered structure of the photo film of FIG. 1.

An effective frame region **2*b* is determined between the two trains of the perforations 3 in the photo film 2. As illustrated in FIG. 2, the photo film 2 is constituted by base material 4 and a coating of emulsion layer 5 applied to the base material 4. During photography, exposures are made to the emulsion layer 5 inside the effective frame region 2*b*. When the photo film 2 is developed after the exposures, the emulsion layer 5 is processed to be an image layer (not shown), with visible frames 6 created (See FIG. 1). Note that operation of the present invention is irrespective of developed or undeveloped statuses of the emulsion layer 5 on the base material 4**.

The base material 4 is formed of transparent polyethylene terephthalate (PET), which has high tensile strength even at a small thickness. The thickness Tb of the base material 4 is 120 μm. It is possible to determine Tb in a range of 100–200 μm. Preferably Tb can be 100–150 μm. Note that, besides PET, the base material 4 may be any high tensile film of other plastics of a polyester type.

Figure 3:
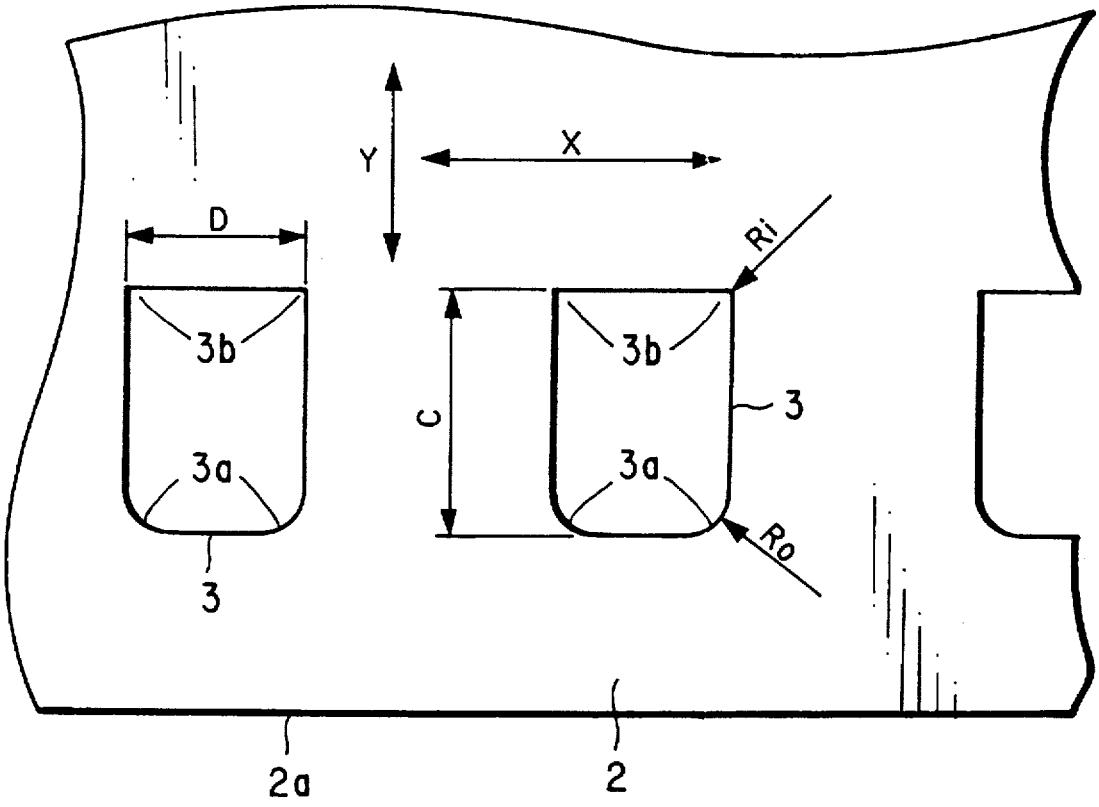
FIG. 3 is a plan view in enlargement, illustrating perforations in the photo film.

FIG. 3 illustrates part of the photo film 2 in enlargement. Each of the perforations 3 has a rectangular shape, and is longer in the width direction Y of the photo film 2. Two corners 3*a* of the perforations 3 are close to the edge 2*a*, and are substantially rounded. Two corners 3*b* of the perforations 3 are close to the effective frame region 2*b*, and are slightly rounded but nearly rectangular as viewed even magnified. The corners 3*a* are defined between two sides intersecting perpendicularly, and rounded at a radius of curvature Ro=0.50 mm. Namely, the corners 3*a* have the standardized shape of KS perforations in photo film defined in JIS-K-7552, 1981, in which corners of a KS perforation are rounded at a radius of curvature R=0.51±0.010 mm. The corner 3*b* is defined between two sides intersecting perpendicularly, and rounded only at a radius of curvature Ri≦0.03 mm. Although an idealized shape of the corners 3*b* is completely angular without curvature, it is inevitable that some rounding takes place in the corners 3*b* due to the punching step of the perforations 3 in the course of the manufacturing the photo film 2. It is preferable that Ri is 0.03 mm or smaller.

Let C be a length of the perforations 3. Let D be a width of the perforations 3. In the perforations 3 C=2.794 mm, and D=1.980 mm. In JIS-K-7552, 1981, a KS perforation is defined to have C=2.795±0.010 mm, and D=1.981±0.010 mm. This being so, the perforations 3 and the photo film 2 are compatible with the perforations and 35 mm photo film for motion picture as defined in JIS-K-7552, 1981.

In the factory to punch out the perforations 3, a punch device and a die device cooperate in conventional fashion for forming the perforations 3, without any change but the shapes of the punch device and the die device adapted to the novel shape of the perforations 3. It is unnecessary to form a separate specified hole in the photo film for the purpose of inducing cutting of the photo film. No holes or cutouts are formed in the photo film 2 besides the perforations 3. Consequently a sound track or a recording area of sound data can be disposed in fully usable form.

The corners 3*b* close to the effective frame region 2*b* are nearly rectangular. When excessive tensile force is applied to the photo film 2 in the length direction X of the photo film 2, the stress due to the tensile force is concentrated at the corners 3*b*, which start being torn, to let the photo film 2 break in its width direction Y. No deformation occurs in the photo film 2 in the length direction X, as the photo film 2 is not elongated forcibly due to the tensile force. The cutting is induced in the width direction Y, not in the length direction X. Therefore, plurality of the frames 6 on the photo film 2 will not be damaged at one time. With the photo film 2 having the sound track or the recording area of sound data near to the perforations 3, deformation and damage of those areas can be lessened. Damage of recorded sound information thus can be minimized. Consequently it is possible to reduce the damage to images and sound even when the photo film 2 is broken in the course of photography or projection.

Figure 6:
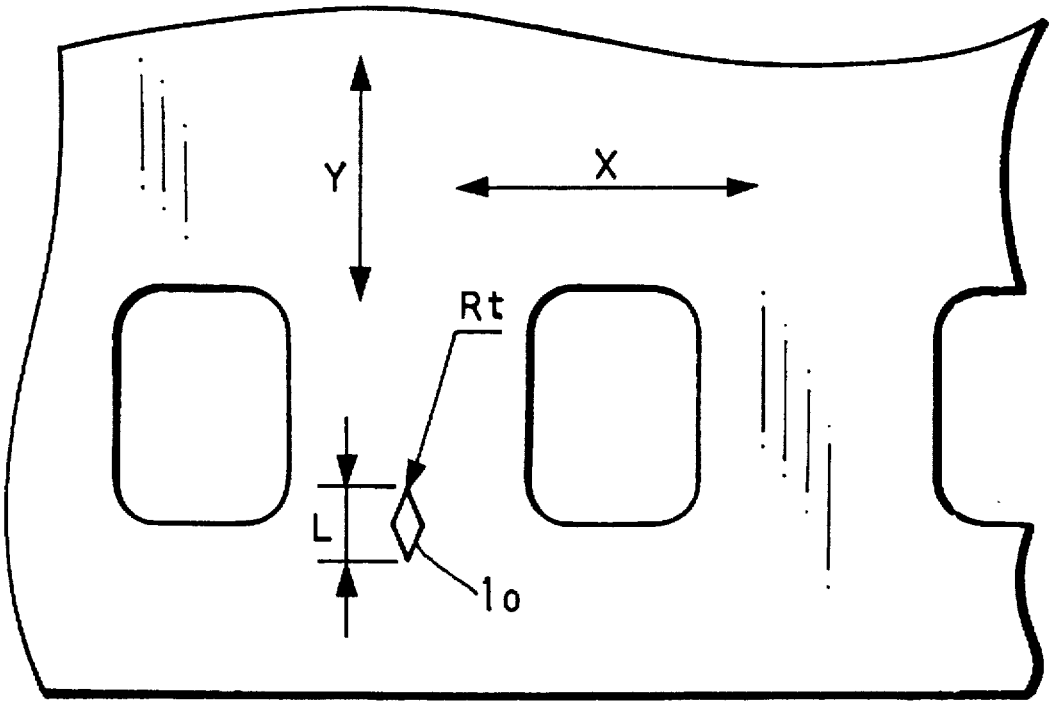
FIG. 6 (PRIOR ART)
FIG. 6 is a plan view in enlargement, illustrating photo film with an auxiliary hole, according to the prior art.

Experiments were conducted to measure critical tensile force (breaking force) at which the photo film 2 was broken. In the experiments, a testing machine similar to a motion picture projector was used, and operated in the same speed as the latter. The observation of the breaking of the photo film 2 was repeated five times. As comparable examples, two other conventional photo films for motion picture were tested: a widely used type of high tensile 35 mm photo film with conventional perforations and without any hole 10; and high tensile 35 mm photo film of JP-A 6-11794 with an auxiliary rhombic hole 10 and conventional perforations. The latter is depicted in FIG. 6, in which the auxiliary rhombic hole 10 had a length L=1.0 mm. Let Rt be a radius of curvature of a corner directed in the width direction Y of the photo film. The auxiliary rhombic hole 10 had Rt=0.01 mm.

Figure 4:
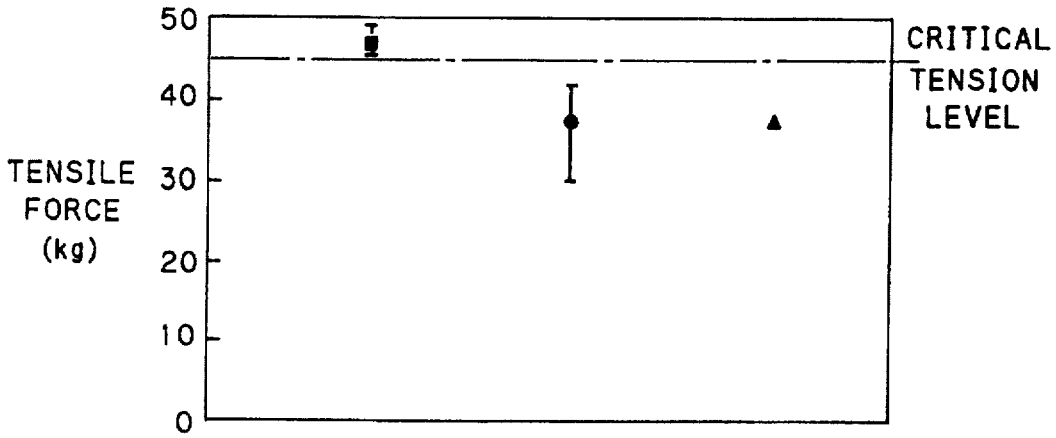
FIG. 4 is a chart illustrating tensile force at which each of a plurality of photo films was broken, in comparison with the critical tension level.

In the chart of FIG. 4, the circular dot represents the photo film 2 of the present invention. The square dot represents high tensile photo film of PET without the hole 10. The triangular dot represents high tensile photo film of PET with the hole 10 of FIG. 6. As illustrated in FIG. 4, the conventional high tensile photo film was broken only after the tensile force to the photo film 2 exceeded the critical level, indicated by the one-dot-chain line in the drawing. The critical level was a level at which standard roller shafts of a motion picture projector start being deformed. Besides the deformation of the roller shafts, the photo film 2 was deformed in the length direction X over a length of a number of feet.

The photo film 2 having the novel perforations of the present invention, when the tensile force was applied to the photo film 2 and came up toward a critical level, was even before the tensile force reached the critical level. Actual points of the breakage depended on individual cases of portions of the photo film 2. Even before deformation of roller shafts of a motion picture projector or the like, the corners 3*b* were torn by excessive tensile force operated to the photo film 2. No deformation of the photo film 2 took place in the length direction X. It was thus possible to reduce the number of damaged frames as exposed on the photo film 2. In most of the five test, the breaking of the photo film 2 occurred at the force nearly equal to the force of the photo film of FIG. 6 with the auxiliary rhombic hole 10. It was observed that the perforations 3 having the novel shape was as effective as the addition of the auxiliary rhombic hole 10. This equality in operation is based on the theoretical background, which is hereinafter described.

Figure 5:
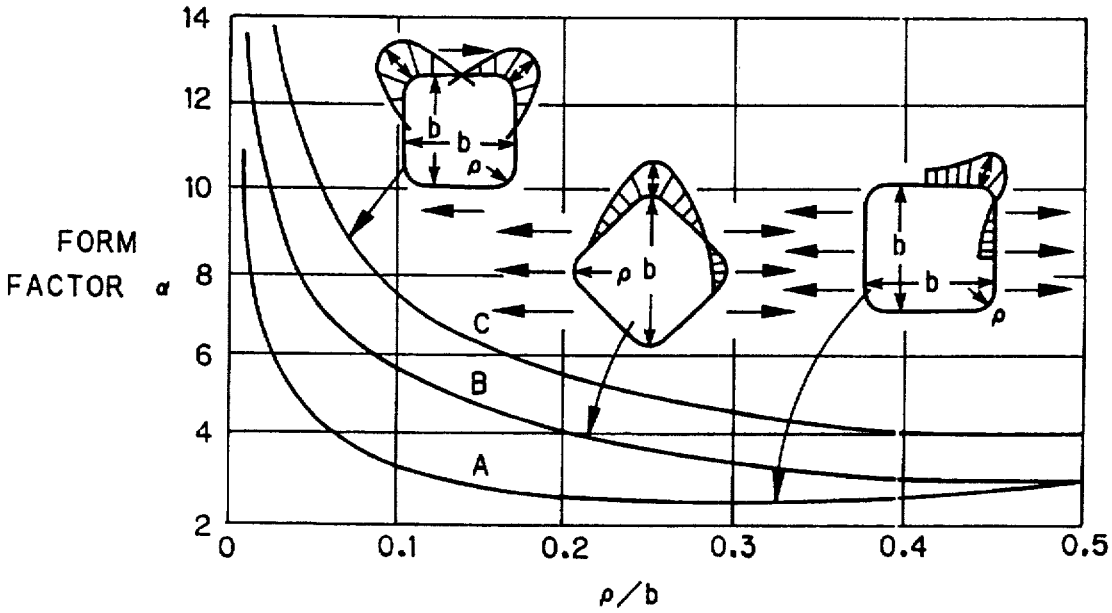
FIG. 5 is a graph illustrating a form factor α of a regular quadrangle formed in a plate.

FIG. 5 is a graph illustrating a form factor α of a hole of a regular quadrangle formed in a plate of a sufficiently large size. The horizontal axis is a ratio ρ/b of the hole size at which the stress concentration occurs; where ρ is a radius of curvature at which a corner of a regular quadrangle is rounded, and b is an inner size of the hole in a direction perpendicular to the tensile load. In the graph, a characteristic curve A is plotted by application of tensile load in parallel with two sides of the regular quadrangle. The stress concentration occurring in the perforations of the present invention is approximated by the characteristic curve A. Note that characteristic curves B and C are plotted for reference. The characteristic curve B is based on application of tensile load along a diagonal of a hole of a regular quadrangle of which the diagonal is b long. The characteristic curve C is based on application of tensile load in two directions: a first direction along an upper side of a hole of a regular quadrangle and a second direction along a lower side of the hole and opposite to the first direction.

In the conventional KS perforations, b is 2.794 mm, and ρ is 0.51 mm. Therefore, $\rho/b=0.51/2.794=0.1813$ The characteristic curve A in FIG. 5 is referred to at 0.1813, to find the form factor $\alpha=2.5$. With the perforations 3 of the present invention depicted in FIG. 3, the corner **3*b* has $\rho/b=0.01$, and then the form factor $\alpha=12$. With the auxiliary rhombic hole 10 of FIG. 6, L=b=1.0 mm, and Rt=ρ=0.01 mm. The auxiliary rhombic hole 10** has $\rho/b=0.01$, and then the form factor $\alpha=12$.

The form factor α constitutes factor of stress concentration. Let $\sigma_n$ be stress, namely outer force per unit sectional area. The stress concentration is expressed as follows:

$$\sigma_{max}=\alpha\cdot\sigma_n$$

Therefore it is possible to evaluate the easiness of the breaking of the photo film in accordance with the form factor α of each perforation or auxiliary hole. In the present invention, the form factor α of the perforations 3 at the corner **3*b* is equal to that of the auxiliary rhombic hole 10 of FIG. 6**, and is greater than the form factor α of the conventional KS perforations. The novel perforation has sufficiently great stress concentration, so that the breakage of the photo film is induced.

Note that, in the preferred embodiment above, the two corners **3*b* are rounded to an extremely small extent (Ri). It is possible that only either one of the two corners close to the effective frame region 2*b* is rounded at the radius Ri of curvature of 0.03 mm or less, for the purpose of facilitating the tearing of the photo film 2. In the embodiment above, the two trains of the perforations 3 are formed. The present invention is also applicable to photo film with a single train of perforations formed on either one of the edges 2*a*. The photo film 2** above is 35 mm photo film for the motion picture. The present invention is applicable to 16 mm photo film, and/or photo film for still photography, and/or photo film with BH (Bell and Howell) perforations.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A photo film, including first and second edges extended in a length direction, and perforations formed between at least said first edge and an effective frame region and arranged in said length direction at a regular pitch, wherein said perforations respectively include first to fourth corners, said first and second corners being located close to said effective frame region, and said third and fourth corners being located close to said first edge, said first corner being defined between two sides of said perforation that intersect perpendicularly.

2. A photo film as defined in claim 1, wherein said perforations comprise first and second trains, said first train is disposed between said first edge and said effective frame region, and said second train is disposed between said second edge and said effective frame region.

3. A photo film as defined in claim 2, wherein said second corner of said perforations has a radius of curvature of 0.03 mm or less.

4. A photo film as defined in claim 3, wherein said perforations are compatible with devices for KS perforations.

5. A photo film as defined in claim 4, wherein said third and fourth corners of said perforations each have a radius of curvature of 0.51±0.010 mm.

6. A photo film as defined in claim 4, said photo film including a base material and an emulsion layer applied to coat said base material and exposed in photography;

said base material being formed of a polyester plastic.

7. A photo film as defined in claim 6, said photo film being 35 mm photo film.

8. A photo film as defined in claim 6, wherein said base material is formed of polyethylene terephthalate.

9. A photo film as defined in claim 8, wherein said base material is 100–200 μm thick.

* * * * *